US008141253B2

(12) United States Patent
Royle

(10) Patent No.: US 8,141,253 B2
(45) Date of Patent: Mar. 27, 2012

(54) PERSONAL CARE ASSEMBLY

(75) Inventor: Terence Gordon Royle, Hampshire (GB)

(73) Assignee: The Gillette Company, Boston, MA (US)

( * ) Notice: Subject to any disclaimer, the term of this patent is extended or adjusted under 35 U.S.C. 154(b) by 592 days.

(21) Appl. No.: 11/897,561

(22) Filed: Aug. 31, 2007

(65) Prior Publication Data

US 2009/0056137 A1 Mar. 5, 2009

(51) Int. Cl.
*B26B 19/00* (2006.01)

(52) U.S. Cl. ..... 30/34.05; 30/34.1; 30/DIG. 1

(58) Field of Classification Search ..... 30/34.1, 30/34.05, 122, DIG. 1, DIG. 2
See application file for complete search history.

(56) References Cited

U.S. PATENT DOCUMENTS

| | | | | |
|---|---|---|---|---|
| 2,764,811 | A * | 10/1956 | Guardino | 30/34.05 |
| 3,550,280 | A * | 12/1970 | Palm | 30/217 |
| 4,084,123 | A * | 4/1978 | Lineback et al. | 30/DIG. 1 |
| 5,046,249 | A * | 9/1991 | Kawara et al. | 30/44 |
| 5,058,273 | A * | 10/1991 | Streger | 30/164.9 |
| 5,259,116 | A * | 11/1993 | Laube | 30/216 |
| 6,112,414 | A * | 9/2000 | Andis et al. | 30/231 |
| 6,139,359 | A * | 10/2000 | Fuhreck et al. | 439/500 |
| 6,378,210 | B1 * | 4/2002 | Bickford | 30/122 |
| 6,684,507 | B2 * | 2/2004 | Lau et al. | 30/34.1 |
| 6,836,965 | B1 * | 1/2005 | Ross | 30/43.6 |
| 6,887,244 | B1 * | 5/2005 | Walker et al. | 606/80 |
| 7,484,982 | B1 * | 2/2009 | Royle | 439/311 |
| 7,503,117 | B2 * | 3/2009 | Wetzel et al. | 30/34.1 |
| 7,656,131 | B2 * | 2/2010 | Embrey et al. | 320/162 |
| 7,877,880 | B2 * | 2/2011 | Royle | 30/541 |
| 7,900,359 | B2 * | 3/2011 | Royle | 30/34.1 |
| 2002/0162226 | A1 * | 11/2002 | Abraham et al. | 30/210 |
| 2003/0056374 | A1 * | 3/2003 | Langley | 30/200 |
| 2003/0106219 | A1 * | 6/2003 | Lau | 30/34.1 |
| 2005/0058890 | A1 * | 3/2005 | Brazell et al. | 429/99 |
| 2005/0159752 | A1 * | 7/2005 | Walker et al. | 606/167 |

(Continued)

FOREIGN PATENT DOCUMENTS

CA 2212561 * 2/1998

(Continued)

OTHER PUBLICATIONS

PCT International Search Report and Written Opinion dated Jan. 27, 2009 (13 pgs).

(Continued)

*Primary Examiner* — Jason Daniel Prone
(74) *Attorney, Agent, or Firm* — Ronald T. Sia; Kevin C. Johnson; Steven W. Miller

(57) ABSTRACT

A personal care apparatus includes a handle housing a rechargeable battery and a plurality of operating heads such as a vibrating safety razor head and a hair trimming device exchangeably mountable on the handle for assembling different hand-held appliances for performing respective body treatments. A base is included for storing the components of the apparatus when not in use and forms a battery charging device with a socket into which the handle plugs for recharging the battery. The operating heads include electrical devices, in particular electric motors, powered by the battery.

16 Claims, 8 Drawing Sheets

U.S. PATENT DOCUMENTS

| | | | | |
|---|---|---|---|---|
| 2005/0217115 | A1 | 10/2005 | Blaustein et al. | |
| 2006/0168816 | A1 | 8/2006 | Wetzell et al. | |
| 2008/0000089 | A1* | 1/2008 | Pennella et al. | 30/34.1 |
| 2008/0052914 | A1* | 3/2008 | Bednar | 30/216 |
| 2008/0086887 | A1* | 4/2008 | Park et al. | 30/29.5 |
| 2008/0185993 | A1* | 8/2008 | Johnson et al. | 320/118 |
| 2008/0209733 | A1* | 9/2008 | Johnson | 30/41 |
| 2009/0056139 | A1* | 3/2009 | Royle | 30/34.05 |
| 2009/0056148 | A1* | 3/2009 | Royle | 30/277.4 |
| 2010/0011585 | A1* | 1/2010 | Maichel et al. | 30/34.1 |
| 2010/0037463 | A1* | 2/2010 | Maichel et al. | 30/34.1 |
| 2011/0214289 | A1* | 9/2011 | Maichel et al. | 30/34.1 |
| 2011/0219620 | A1* | 9/2011 | Rehbein et al. | 30/34.1 |
| 2011/0225826 | A1* | 9/2011 | Leventhal | 30/34.1 |

FOREIGN PATENT DOCUMENTS

| | | | |
|---|---|---|---|
| DE | 29508203 | U1 * | 9/1995 |
| WO | WO 2005/077613 | | 8/2005 |
| WO | WO 2009027928 | A1 * | 3/2009 |
| WO | WO 2009027930 | A1 * | 3/2009 |
| WO | WO 2009027945 | A1 * | 3/2009 |

OTHER PUBLICATIONS www.braun.com/na/cruzer/cruzer.html—Braun Cruzer product website. Product description (23 pgs), Jul. 13, 2004.

* cited by examiner

PERSONAL CARE ASSEMBLY

FIELD OF THE INVENTION

This invention relates to personal care apparatus and in particular an apparatus that provides a variety of battery driven appliances for performing respective body treatments. This invention is specifically described herein with reference to a personal grooming apparatus.

BACKGROUND OF THE INVENTION

There are known different kinds of electrical appliance that are intended for performing personal care treatments on the body of the user. In a personal grooming context such appliances include safety razor with sharp blades for closely shaving body skin areas and equipped with electrical devices, such as motor driven vibration generating devices, and hair trimmers with different blade configurations to suit different hair trimming and shaping duties and having motor driven cutters for severing hairs with a shearing action. Although it is known to integrate a safety razor and an electrically driven hair trimming device, due to the different power requirements of electric motors used for driving the cutters of a hair trimming device and for driving a vibration generating device in a safety razor, it is not practical to integrate in a similar manner a vibrating safety razor and a hair trimming device. Thus, the motor required for producing vibrations of a shaving cartridge in a wet shaving razor, such as a razor manufactured and sold by The Gillette Company under the trade mark M3 Power, is not powerful enough to drive the cutter blades of a trimmer of the kind provided on electric dry razors, and conversely a motor as used to drive a trimmer would be too large and draw too much battery power for efficient use in generating vibrations of a safety razor. Another disadvantage of integrated devices is that the hair trimmer generally has a secondary role in comparison with the main use of the appliance and is not optimally positioned to facilitate most effective and convenient use. A further drawback with a trimmer integrated with a safety razor is the exposure of the trimmer blades and actuating system to water when the safety razor is immersed into a body of water for rinsing shaving debris and soap from the blades.

SUMMARY OF THE INVENTION

With the foregoing considerations in mind there is provided in accordance with the present invention a personal care apparatus comprising: a handle including electrical contacts, and a battery compartment for accommodating a battery for supply of electric current to the electrical contacts; a plurality of operating heads exchangeably mountable on the handle for performing respective body treatments, each of the operating heads including an electric device, and electrical contacts for cooperation with the contacts on the handle for supply of electric current to the electric device when the respective operating head is mounted to the handle; wherein the electrical devices of at least first and second operating heads comprise electric motors.

With an apparatus embodying the invention a common handle and hence battery power supply can be used to assemble a range of different appliances having electric motors with different power characteristics suited to operation of the respective appliances. Since only a single handle is needed for several appliances it can be made as a high value component without making the collection of appliances provided overly expensive. The respective operating heads can be readily exchangeable on the handle and can be equipped with their own motors and/or other electrical devices designed for optimum performance of the individual operating heads.

For reasons of economy the handle preferably includes a switch for controlling supply of electric current for the electrically operated device of an operating head mounted on the handle. However, one or more of the operating heads may be equipped with a switch mechanism or an electronic switching arrangement if desired. The electric device of at least a first one of the operating heads may comprise an electric motor for driving a vibration generating device included in the operating head. Furthermore, at least a second one of the operating heads may comprise an electric motor and a treatment element movably mounted to the operating head, the treatment element being coupled to the motor to be driven thereby and being arranged on the operating head for contact with a body part for performing a body treatment with the operating head. In an embodiment of a personal grooming apparatus, an operating head with a motor driven vibration generating device is preferably a safety razor head that forms a vibrating razor when fitted onto the handle, and the safety razor head is ideally adapted to carry a detachable shaving cartridge. A convenient and low cost form of vibrating device is a coin motor, or a motor that drives an eccentric weight, both as known per se. The second operating head can comprise a hair trimmer unit comprising at least one trimmer blade assembly having a trimmer blade driving element coupled to be driveable by the electric motor of this operating head. In a preferred construction the trimmer unit comprises a plurality of trimmer blade assemblies, and the trimmer unit is movably mounted on a drive unit of the operating head for selectively positioning any one of the blade assemblies at an operative hair trimming position. The apparatus may also include at least one comb attachment releasably engageable over the trimmer blade assembly for increasing the hair length to which the trimmer unit is operable to trim hairs, and in this way the performance capabilities of the trimmer unit are extended in an especially convenient and economic way.

Since respective operating heads of the apparatus are equipped with their own respective motors, the motors can be chosen based solely on the demands of the individual operating heads. Consequently it is a preferred feature of the apparatus that at least two operating heads have motors with differing electrical power requirements, and hence power outputs, for operation of the respective operating heads in the performance of the body treatments.

A coupling is provided for detachably connecting the handle to each of the operating heads. In one embodiment the handle has an end coupling part formed as a female coupling member comprising a cylindrical sleeve portion with a first electrical contact being disposed within the sleeve portion and another electrical contact being formed by the sleeve portion. Each operating head has a complementary male coupling member comprising a plug part slidably engageable in the sleeve portion, and having a radial projection for engagement with a bayonet slot formed in the sleeve portion for releasably mechanically locking the male member to the female coupling member. The male member includes a second central electrical contact for electrical connection with the first contact of the female coupling member, and the plug part serves as a further electrical contact for connection with the sleeve portion.

Although the handle could be arranged to accommodate a disposable battery intended to be discarded and replaced when its change has been exhausted, in a preferred apparatus embodying the invention a rechargeable battery is received in the battery compartment, and the apparatus includes a charging device for recharging the battery. The charging device preferably includes electrical contacts for cooperation with the electrical contacts of the handle when the charging device is engaged with the charging device for recharging the battery. This has the advantage that the handle must be disconnected from an operating head when being recharged, with the result that an operating head can not be operated while the battery is being recharged, which could be a potential safety hazard in some situations.

The charging device is conveniently included in a storage holder provided with holding regions designed for receiving the operating heads for storage during periods of non-use.

A better and more complete understanding of the foregoing and other features and advantages of the invention will be gained from the detailed description of an embodiment which follows:

DETAILED DESCRIPTION OF THE INVENTION

Figure 1:
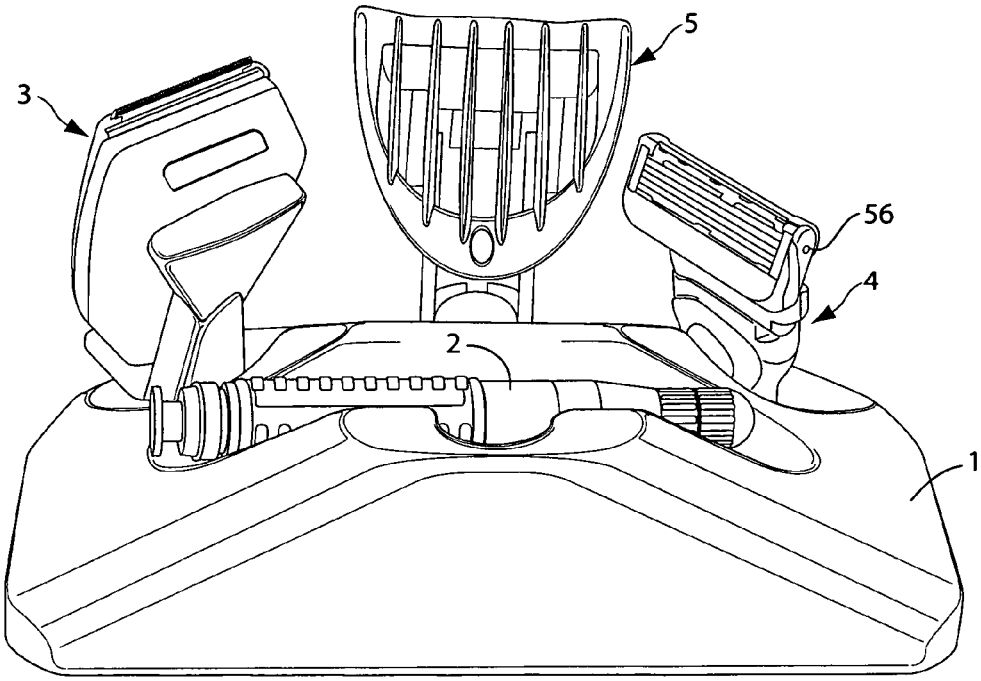
FIG. 1 is an illustration of a personal hair grooming apparatus embodying the invention.
Figure 2:
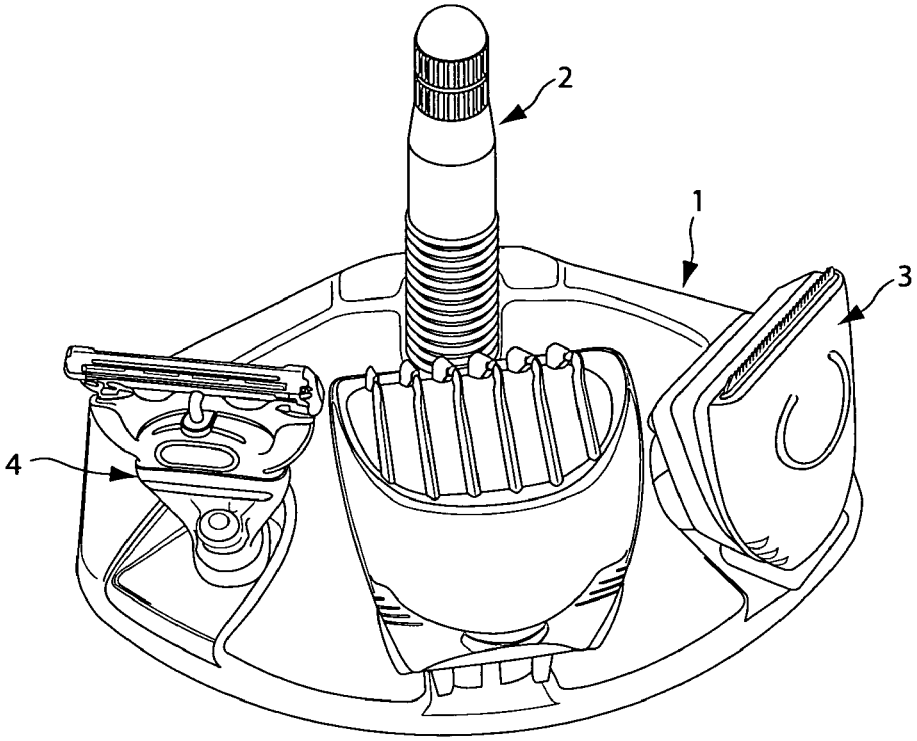
FIG. 2 shows the apparatus of FIG. 1 but with the handle engaged with a recharging device for recharging the battery housed in the handle.
Figure 3:
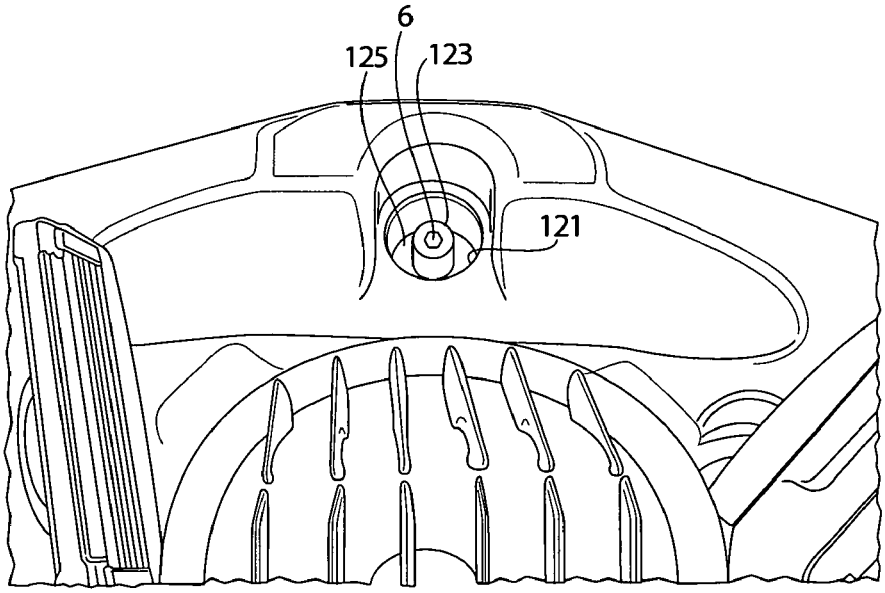
FIG. 3 is a view from above showing the connection socket of the recharging device.
Figure 4A:
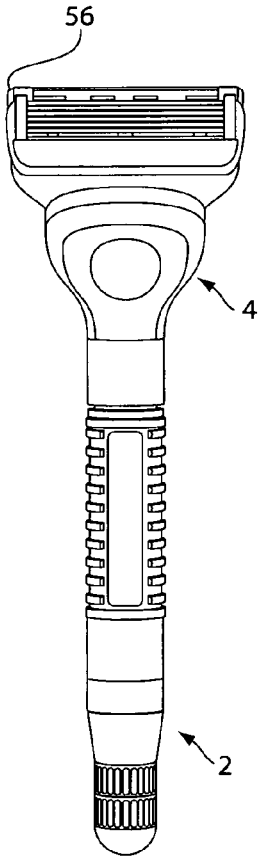
FIGS. 4*a*, 4*b*, and 4*c* are front elevations showing respective appliances assembled from the components of the apparatus illustrated in FIG. 1.
Figure 4B:
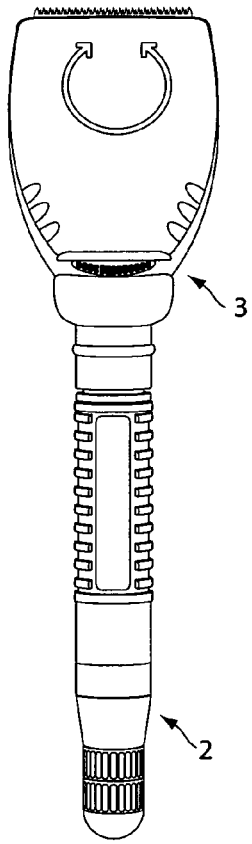
Figure 4C:
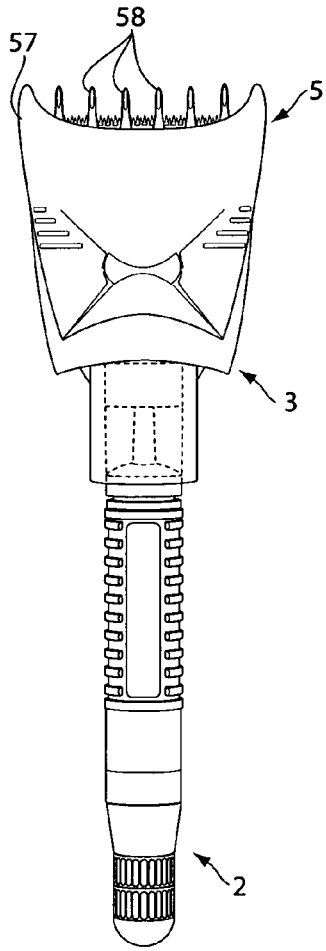
Figure 5:
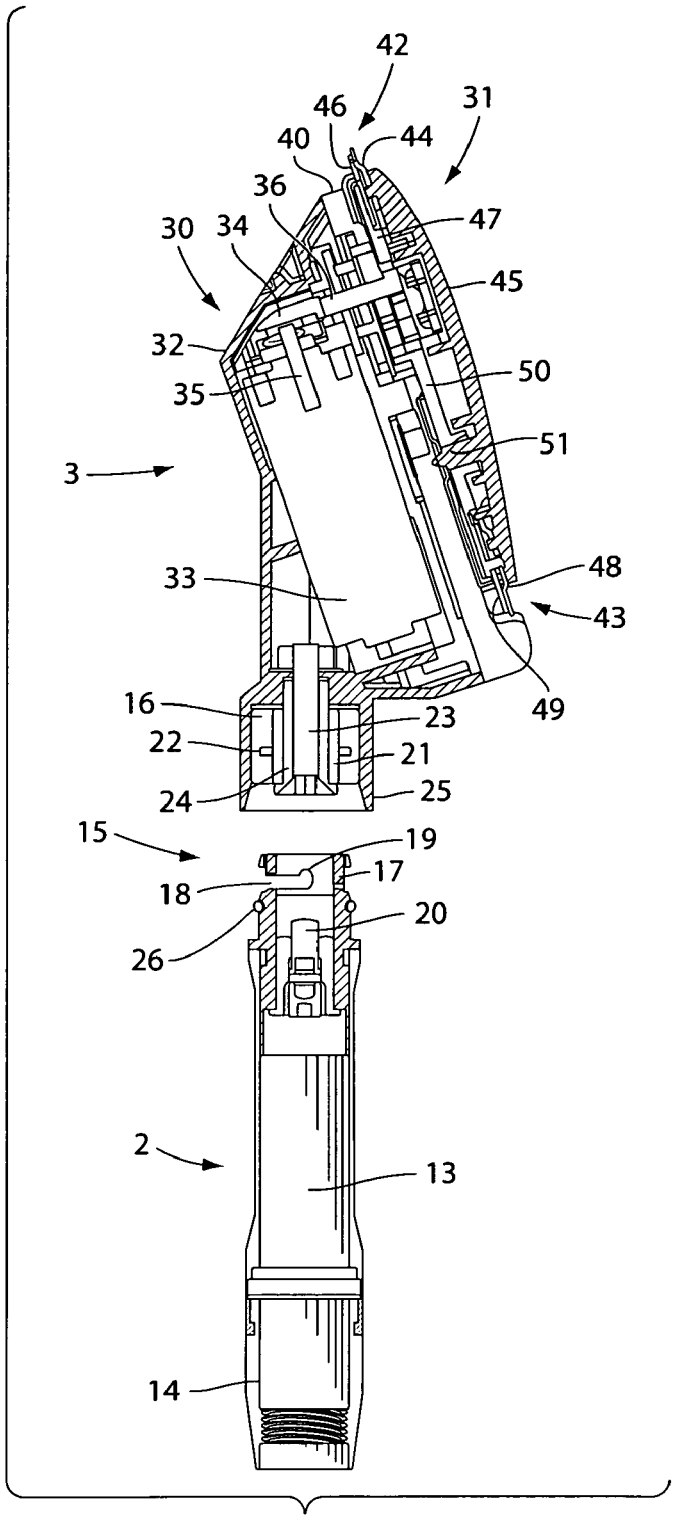
FIG. 5 is an axial section through the handle and an operating head in the form of a hair trimming device.
Figure 6:
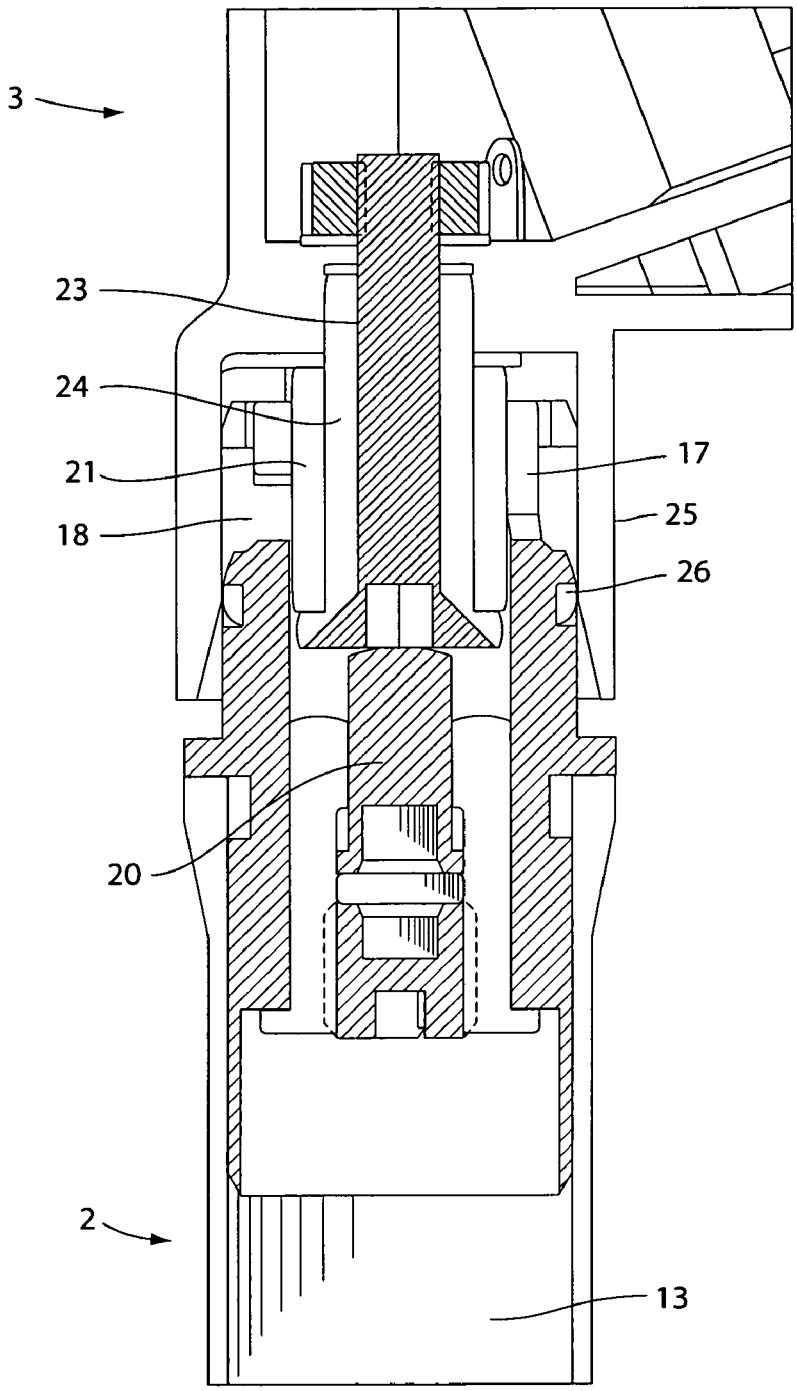
FIG. 6 is an enlarged axial cross-section through the assembled coupling region of the handle and the hair trimming device shown in FIG. 5.

A personal care apparatus, in particular a personal grooming apparatus in accordance with the invention is illustrated in FIGS. 1 and 2. The components of the apparatus comprise a base 1, a handle 2, a hair trimming device 3, a safety razor head 4 and a trimmer comb attachment 5. The base 1 forms a storage holder for the other components and for this purpose is provided with recessed holding regions for the handle 2 and the operating heads 3, 4, and a stand for the comb attachment 5. The base also houses a battery charger and is provided with a recharging socket 6 for the handle to plug into as further described below. The trimming device 3 and the safety razor head 4 are detachably mountable on the handle 2 for assembly of respective hand held grooming appliances, specifically a hair trimmer, as shown in FIG. 4*b*, and a vibrating safety razor, as shown in FIG. 4*a*. In addition the comb attachment 5 can be fitted onto the trimming device 3 to form a modified trimmer as shown in FIG. 4*c*. The hair trimming device 3 and the handle are illustrated in more detail in FIG. 5. The handle 2, which forms a power supply unit, includes a battery compartment in which a rechargeable battery 13 is accommodated, and a switch arrangement 14 for controlling supply of electric current from the battery 13 to the trimming device 3 when mounted to the handle. A coupling is provided for electrically and mechanically connecting the handle to the trimming device and comprises a female coupling member 15 on the handle 2 and a male coupling member 16 on the trimming device 3. The assembled coupling is shown on an enlarged scale in FIG. 6. The female coupling member 15 includes a sleeve portion 17 located at the upper end of the handle and provided with a pair of symmetrical bayonet slots 18 with locking recesses 19 at their ends. Positioned centrally within the sleeve portion 17 is a first electrical contact 20 in the form of a pin which is spring-loaded and urged axially towards the upper end of the handle. The male coupling member 16 has a plug part 21 adapted to mate with the female coupling member by sliding engagement in the sleeve portion 17, and the plug part has a pair of diametrically opposed pin projections 22 arranged for cooperation with the respective bayonet slots 18. A second electrical contact 23 is located centrally within the plug part 21 with an electrical insulator 24 being disposed therebetween. When the male and female coupling members 15, 16 are fully engaged the first and second contacts 20, 23 are pressed into close abutment due to the spring loading of the first contact, and this spring loading also serves to urge the pin projections 22 into the locking recesses 19 of the bayonet slots 18 to secure the trimming device 3 against unintentional disconnection from the handle 2. Additional spring forces can be applied by spring mounting the central contact 23 in the male plug part 21. The sleeve portion 17 and the plug part 21 form further electric contacts that cooperate to complete a circuit for the flow of electric current between the battery in the handle and the trimming device. Preferably the central contacts 20, 23 provide the positive polarity connection and the contacts 17, 21 the negative polarity connection of the electrical connector. The trimming device 3 includes a hood or shroud 25 which surrounds the plug part 21 for enclosing the male and female members of the bayonet coupling to preclude ingress of moisture to the electrical contacts. The female member carries an annular seal 26, such as an O-ring seal, disposed in a peripheral groove provided on the sleeve portion 17 axially inwardly of the bayonet slots 18, and the shroud 25 has a close fit over the seal 26 to ensure a watertight connection between the shroud and the handle when the male and female coupling members are engaged.

The trimming device includes a drive unit 30 and a trimmer unit 31. The male coupling member 16 and the shroud 25 are provided on a housing 32 of the drive unit in which is housed an electric rotary motor 33 and a transmission mechanism 34 for converting rotary motion of a motor shaft 35 into reciprocation of a drive output member 36 in the form of a drive pin. The electric terminals of the motor are connected to the electrical contacts 21 and 23 of the trimming device for supply of current from the battery 13 in the handle for driving the motor. Connected to the front of the drive unit is a mounting plate 40 for the trimmer unit 31, the mounting plate being guided for up and down translatory movement relative to the drive unit for purposes which will become clear. The trimmer unit is held to the mounting plate 40 so that the trimmer unit 31 is able to rotate relative to the mounting plate 40 and hence also the drive unit 30. The trimmer unit includes a first trimmer blade assembly 42 and a second trimmer blade assembly 43. The first blade assembly 42 is comparatively long and straight and includes a first trimmer blade 44 fixedly mounted to a face plate 45 of the trimmer unit, and a second trimmer blade 46 guided for reciprocation relative to the first trimmer blade and attached to a blade driving element 47. The second blade assembly 43 is relatively short with a convex profile and includes a first trimmer blade 48 fixedly mounted to the face plate 45 and a second trimmer blade 49 guided for reciprocation along a curved path relative to the first trimmer blade 48 and attached to a blade driving element 50 which is mounted to the face plate 45 by a pivot 51. Each of the blade driving elements 47, 50 includes a slot in which the drive output pin 36 is engageable for reciprocating the blade driving element and also reciprocating the trimmer blade attached to the blade driving element.

Figure 7:
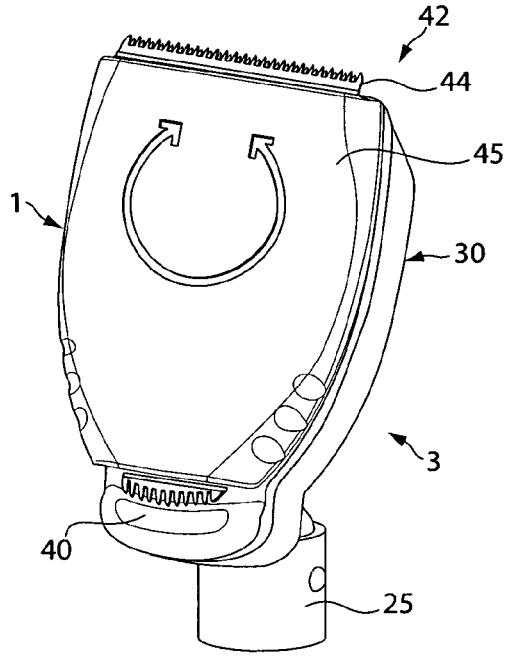
FIG. 7 is a front perspective view of the hair trimming device adjusted with a first trimming blade assembly in an operative position.
Figure 8:
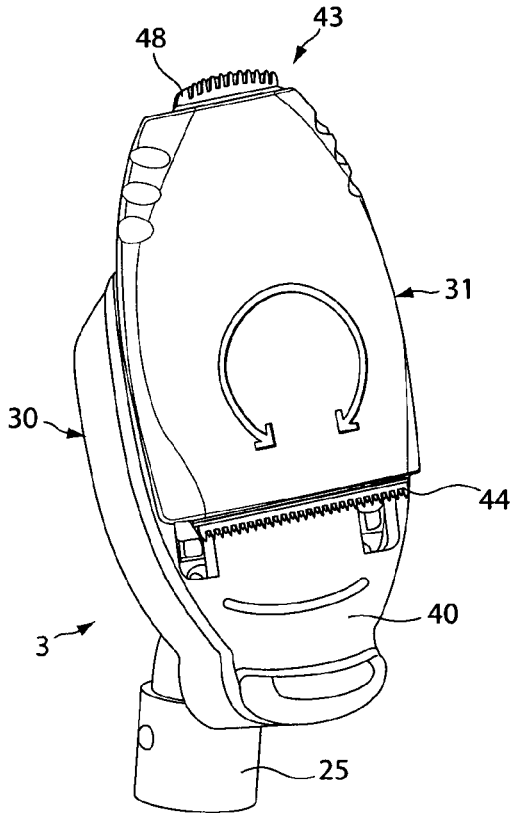
FIG. 8 is a front perspective view of the hair trimming device with a second trimming blade assembly shown in the operative position.
Figure 9:
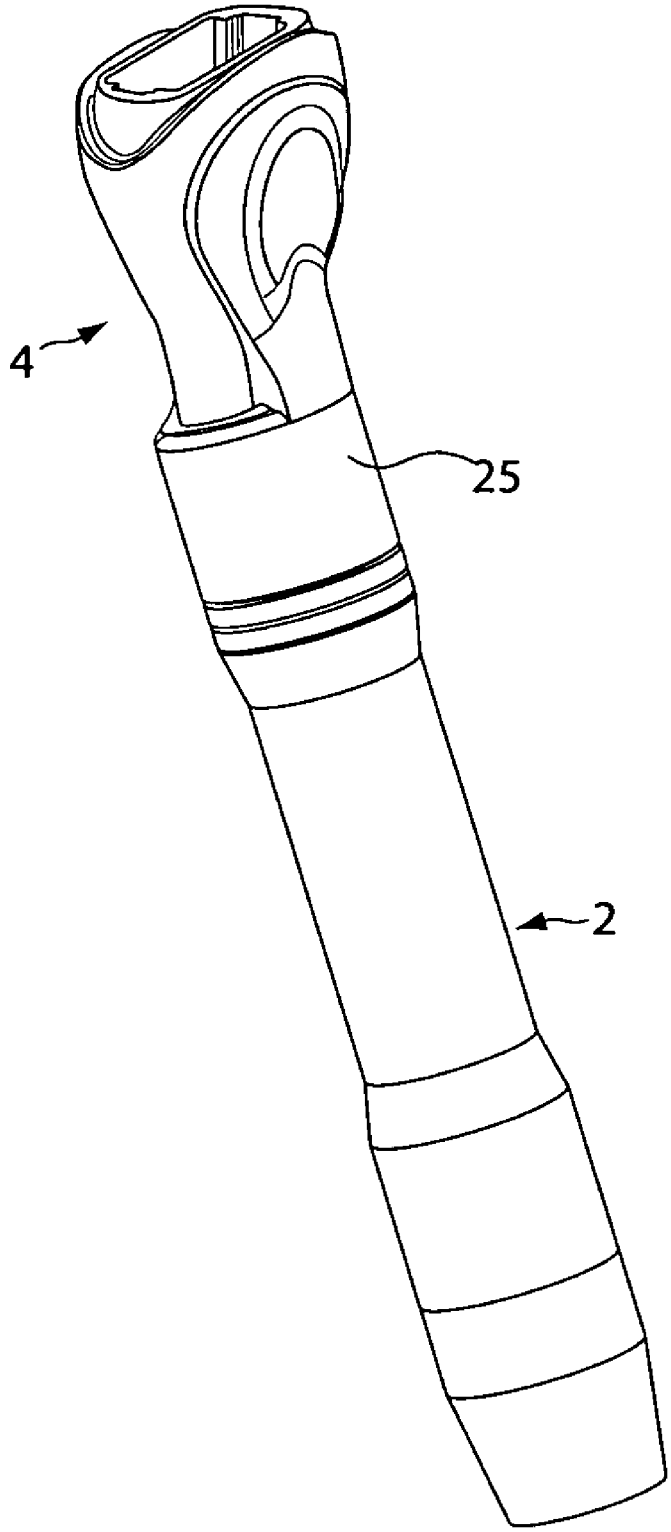
FIG. 9 is a perspective view of the handle assembled with a safety razor operating head adapted to mount a conventional safety razor cartridge.

When the mounting plate 40 is displaced upwardly relative to the drive unit the trimmer unit 31 can be rotated relative to the mounting plate to selectively adjust either the first blade assembly 42 or the second blade assembly 43 to the operative position, as respectively illustrated in FIGS. 7 and 8. Downward displacement of the mounting plate 40 and the trimmer unit then causes the drive output pin 36 to engage in the slot in the blade driving element 47 or 50 of the trimmer blade assembly 42 or 43 disposed in the operative position. Actuation of the motor 33 then puts the selected trimmer blade assembly into operation whilst the other trimmer blade assembly remains uncoupled from the drive output pin 36.

The bayonet coupling described in detail above provides a firm and secure mechanical connection between the handle and the hair trimming device while also ensuring a good electrical connection between them. Furthermore, the coupling can be easily opened to separate the trimming device from the handle, to enable the battery to be recharged and to allow a different form of operating head to be operatively connected to the handle, in particular the safety razor head 4 which is adapted to receive a conventional shaving cartridge 56 and which includes a motor for driving a vibration generating device, such as a coin motor. As will be appreciated the coupling employed to connect the safety razor head 4 to the handle 2 may be exactly as described above with respect to the trimming device 3, with the shroud 25 being sealed to the handle so that water can not reach the electrical contacts even when the razor head is completely immersed in water for rinsing the shaving cartridge.

The motors of the trimming device 3 and the safety razor head 4 have differing requirements and are chosen accordingly. The motor required to vibrate the shaving cartridge in the course of shaving is small and will draw little power from the battery 13. The motor 33 of the trimming device is larger and more powerful and thus requires more battery power. Because respective operating heads are provided to produce appliances specifically adapted to different grooming needs of a user, each appliance can be and is optimally designed in terms of its configuration and motor drive system. Although just two specific forms of operating head have been described it will be appreciated that other additional or alternative forms of operating head mountable on the handle 2 are possible, such as to provide a nose hair trimmer, an exfoliator, an eyebrow trimmer, a skin cream applicator, liquid dispensing razor, and/or a massager. In each case the operating head design and its motor can be uniquely determined as considered best for the kind of appliance concerned. For instance the operative position of the trimmer blade assemblies can be easily arranged with respect to the handle to ensure good visibility in use.

Figure 10:
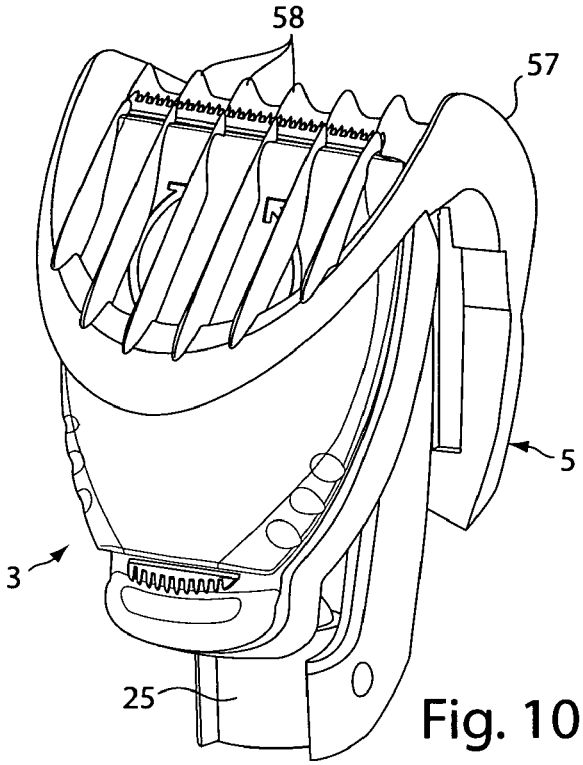
FIG. 10 is a front perspective view of the hair trimming device of FIG. 7 with the comb attachment clipped onto the trimmer.
Figure 11:
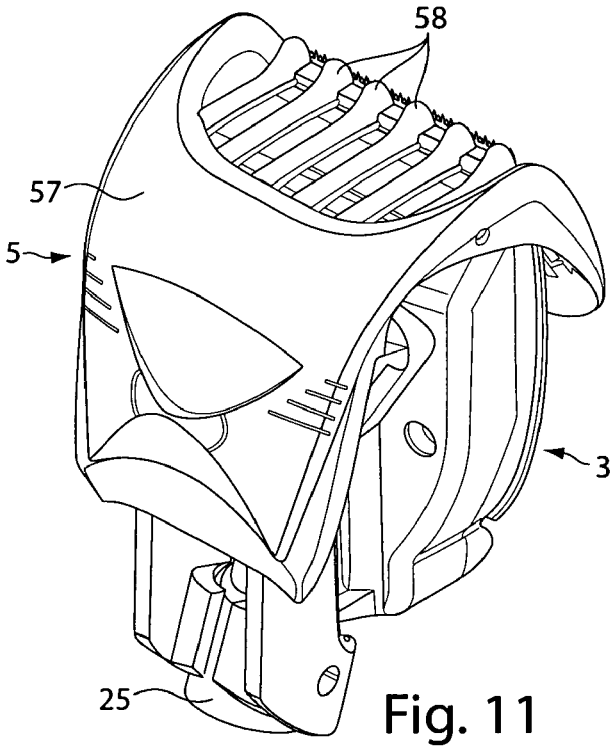
FIG. 11 is a rear perspective view of the hair trimming device and comb attachment shown in FIG. 10.

The versatility of the described hair trimming device is further enhanced by the inclusion of the comb attachment 5 which can, when desired be clipped onto the trimming device as shown in FIGS. 10 and 11. The comb attachment includes a frame 57 and comb elements 58 spaced apart along the first cutter blade assembly 42 and arranged for wrapping over the blades of this blade assembly to maintain the blades at a certain distance from the skin so that hairs can be cut down to a desired length. A range of such clip-on attachments could of course be provided to meet use demands as to desired hair length grades.

The base 1 provides a convenient storage unit for the components of the apparatus while also providing a recharging station for the battery housed in the handle 2. For this purpose, in addition to the necessary electrical recharging circuitry, the base has a connection socket 6 for the handle 2 to plug into as illustrated in FIG. 2. The socket has electrical contacts 21', 23' which replicate those of the male coupling member 16 with which each of the operating heads 3 and 4 is provided. As a consequence, the inverted handle 2 can be inserted into the socket 6 and connected to the base by the bayonet coupling provided thereby bringing the contacts 17 and 20 of the handle into electrical connection with the corresponding socket contacts 21' and 23' for delivering of recharging current to the rechargeable battery 13 in the handle 2. The switch 14 of the handle 2 may be arranged to control the flow of charging current. Alternatively a switch may be provided on the base 1, or a separate switching arrangement could be included in the handle 2, for this purpose. An indicator for indicating the charge state of the battery can also be provided on the base, if desired. The contacts 21', 23' are located within a cylindrical recess formed in the casing of the base and the peripheral wall of this recess can serve to form a sealed enclosure around the connected contacts of the handle and the charging device in the same way as described above with respect to the shroud 25 of the trimming device 3.

All documents cited in the Detailed Description of the Invention are, in relevant part, incorporated herein by reference; the citation of any document is not be construed as an admission that it is prior art with respect to the present invention. To the extent that any meaning or definition of a term in this written document conflicts with any meaning of definition of the term in a document incorporated by reference, the meaning or definition assigned to the term in this written document shall govern.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A personal care assembly comprising:

a handle including electrical contacts, and a battery compartment for accommodating a battery for supply of electric current to the electrical contacts;

a first operating head comprising a safety razor and a second operating head comprising a hair trimmer, wherein each of said first and said second operating heads are exchangeably mountable on the handle, wherein each of said first and said second operating heads comprises an electric device, and electrical contacts for cooperation with the electrical contacts on the handle for supply of electric current to the electric device when a respective one of the operating heads is mounted to the handle; wherein the electrical devices for each of said first and said second operating heads comprise electric motors with differing electrical power requirements, and hence power outputs, for operation of a respective one of the operating heads, wherein the handle has an end coupling part for mechanical connection to each of said first and said second operating heads the end coupling part comprising a cylindrical sleeve portion, wherein said electrical contacts comprises a first electrical contact of the handle being disposed within the sleeve portion and another electrical contact being formed by the sleeve portion, and wherein the cylindrical sleeve portion forms an annular seal disposed on a peripheral groove positioned axially inwardly.

2. The personal care assembly of claim 1, wherein the handle comprises a switch for controlling the supply of electric current to the electric device of an operating head mounted to the handle.

3. The personal care assembly of claim 1 wherein the safety razor is a vibrating safety razor.

4. The personal care assembly of claim 3 wherein the electric motor of the first operating head is a coin motor for generating vibrations.

5. The personal care assembly of claim 1 wherein the safety razor comprises a detachable shaving cartridge.

6. The personal care assembly of claim 1, wherein each of said first and said second operating heads includes a coupling part with a male member slidably engageable in the sleeve portion, and having a radial projection for engagement with a bayonet slot formed in the sleeve portion for releasably locking the male member to the sleeve portion.

7. The personal care assembly of claim 1, wherein the hair trimmer comprises at least one trimmer blade assembly having a trimmer blade element coupled to be drivable by the electric motor.

8. The personal care assembly of claim 7, further comprising at least one comb attachment releasably engageable over the hair trimmer for increasing a hair length to which the hair trimmer is operable to trim hairs.

9. The personal care assembly of claim 1, wherein the hair trimmer comprises a plurality of different trimmer blade assemblies.

10. The personal care assembly of claim 9, wherein the hair trimmer is movably mounted on a drive unit of the second operating head for positioning a selected one of the blade assemblies at an operative hair trimming position.

11. The personal care assembly of claim 1, wherein a rechargeable battery is received in the battery compartment of the handle, and the assembly further comprises a charging device for recharging the battery, the charging device having electrical contacts for cooperation with the electrical contacts of the handle when the handle is engaged with the charging device for recharging the battery.

12. The personal care assembly of claim 11, wherein the charging device is included in a storage holder provided with holding regions for receiving the operating heads during periods of non-use.

13. The personal care assembly of claim 1, wherein the electric motor of the first operating head is a vibrating electric motor.

14. The personal care assembly of claim 13, wherein said vibrating electric motor is a coin motor.

15. The personal care assembly of claim 13, wherein the power output of the electric motor of the second operating head is more powerful than the power output of the vibrating electric motor of the first operating head.

16. The personal care assembly of claim 1, further comprising at least one comb attachment releasably engageable over the hair trimmer.

* * * * *